US011859484B2

(12) United States Patent
Al-Qasim et al.

(10) Patent No.: US 11,859,484 B2
(45) Date of Patent: Jan. 2, 2024

(54) ENHANCED RECOVERY METHOD FOR STRATIFIED FRACTURED RESERVOIRS

(71) Applicant: SAUDI ARABIAN OIL COMPANY, Dhahran (SA)

(72) Inventors: Abdulaziz S. Al-Qasim, Dammam (SA); Subhash C. Ayirala, Dhahran (SA); Dong Kyu Cha, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 79 days.

(21) Appl. No.: 17/651,538

(22) Filed: Feb. 17, 2022

(65) Prior Publication Data

US 2023/0258065 A1 Aug. 17, 2023

(51) Int. Cl.

| | |
|---|---|
| ***E21B 43/14*** | (2006.01) |
| ***E21B 43/25*** | (2006.01) |
| ***E21B 43/267*** | (2006.01) |
| ***E21B 43/00*** | (2006.01) |

(52) U.S. Cl.
CPC ..... *E21B 43/267* (2013.01); *E21B 43/003* (2013.01); *E21B 43/14* (2013.01); *E21B 43/25* (2013.01)

(58) Field of Classification Search
CPC ..... E21B 43/14; E21B 43/25
See application file for complete search history.

(56) References Cited

U.S. PATENT DOCUMENTS

| | | | | |
|---|---|---|---|---|
| 9,133,709 | B2 * | 9/2015 | Huh | E21B 49/008 |
| 2020/0378227 | A1 | 12/2020 | Li et al. | |
| 2022/0213770 | A1 * | 7/2022 | Al-Qasim | E21B 28/00 |

FOREIGN PATENT DOCUMENTS

| | | | |
|---|---|---|---|
| CA | 2962979 | A1 | 3/2011 |
| CA | 3055840 | A1 | 3/2020 |
| WO | 2015/089039 | A1 | 6/2015 |

OTHER PUBLICATIONS

Hou, Y. et al., "The design and simulation of new downhole vibration device about acoustic oil recovery technology", Petroleum 1, pp. 257-263, 2015 (7 pages).

(Continued)

*Primary Examiner* — Catherine Loikith
(74) *Attorney, Agent, or Firm* — Osha Bergman Watanabe & Burton LLP

(57) ABSTRACT

A method for enhancing productivity of a stratified subterranean wellbore includes introducing a mixture including water and a first set of nanoparticles reactive to high frequency acoustic waves having a size ranging from about 10 to 100 nm to a first target zone, located in a high permeability layer of the stratified subterranean wellbore. A first stimulation including acoustic waves having a frequency range of 1 kHz to 10 kHz is provided to the first set of nanoparticles to promote reacting. Then, a mixture including water and a second set of nanoparticles having a size ranging from about 1 to 10 nm is introduced to a second target zone, located in a medium permeability layer of the stratified subterranean wellbore. A second stimulation including acoustic waves having a frequency range of 100 Hz to 1 kHz is provided to the second set of nanoparticles to promote reacting.

12 Claims, 4 Drawing Sheets

(56) References Cited

OTHER PUBLICATIONS

El-Khatib, N., "The Effect of Crossflow on Waterflooding of Stratified Reservoirs", SPE J. 25 (02), pp. 291-302, 1985 (12 pages).
Lai, N. et al., "CO2/N2-Responsive Nanoparticles for Enhanced Oil Recovery During CO2 Flooding", Frontiers in Chemistry, vol. 8, Article 393, 2020 (9 pages).
Achinta Bera et al., "Application of nanotechnology by means of nanoparticle and nanodispersion in oil recovery—a comprehensive review", Journal of Natural Gas Science and Engineering 34, pp. 1284-1309, 2016 (26 pages).
Sergio Kapusta et al., "Nanotechnology Applications in Oil and Gas Exploration and Production", IPTC 15152, 2011 (5 pages).

* cited by examiner

ENHANCED RECOVERY METHOD FOR STRATIFIED FRACTURED RESERVOIRS

BACKGROUND

In order to increase the productivity of a reservoir, several recovery processes may be used. In particular, waterflooding, which is also referred to as an improved oil recovery (IOR) process, may be used to recover hydrocarbons from both sandstone and carbonate reservoirs. The use of waterflooding involves the injection of water into the reservoir to displace or physically sweep a fraction of free unbound oil in the contacted reservoir formation. The fraction of free unbound oil is a measure of the displacement efficiency and depends on the relative permeability characteristics of the rock as well as the viscosities of the displacing and displaced fluids. The displacing fluid tends to move faster in zones with higher permeabilities and subsequently resulting in poor sweep efficiency and earlier breakthrough into producing wells. Both areal and vertical sweep efficiencies are highly dependent on the mobility ratio of the displacement process and depend on the volume of the injected fluid expressed in pore volumes. In stratified fractured reservoirs, waterflooding may suffer from poor sweep efficiencies due to large permeability contrast between different layers and high permeability fractures thereby resulting in much lower oil recoveries.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments disclosed herein relate to a method for enhancing productivity of a stratified subterranean wellbore, including introducing a mixture that includes water and a first set of nanoparticles to a first target zone of the stratified subterranean wellbore. The first set of nanoparticles is reactive to high frequency acoustic waves and has a size ranging from about 10 to about 100 nm. The first target zone is located in a high permeability layer of the stratified subterranean wellbore. The method then includes providing a first stimulation including acoustic waves having a frequency range of 1 kHz to about 10 kHz to the first set of nanoparticles to promote the reacting and introducing water to the first target zone. The method further includes introducing a mixture including water and a second set of nanoparticles to a second target zone of the stratified subterranean wellbore, where the second set of nanoparticles has a size ranging from about 1 to about 10 nm, and where the second target zone is located in a medium permeability layer of the stratified subterranean wellbore. Then, a second stimulation including acoustic waves having a frequency range of 100 Hz to about 1 kHz is provided to the second set of nanoparticles to promote the reacting and water is introduced to the second target zone.

Other aspects and advantages of the claimed subject matter will be apparent from the following description and the appended claims.

DETAILED DESCRIPTION

Figure 1:
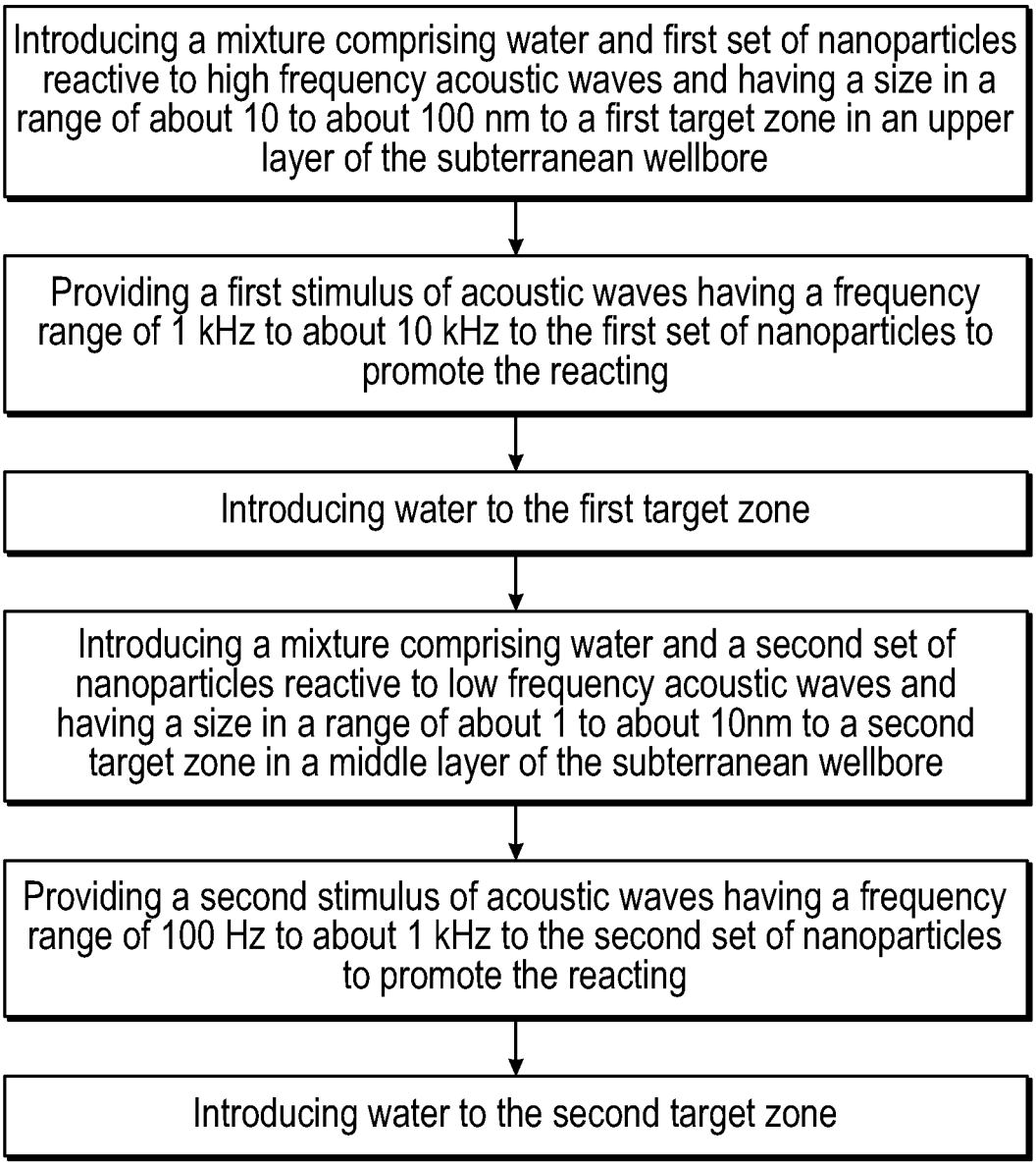
FIG. 1 is a flow diagram that illustrates steps included in the method of enhancing the productivity of a subterranean wellbore production in a stratified fractured reservoir in accordance with one or more embodiments.

Stratified fractured reservoirs may present wide permeability contrasts between different between different layers. When water is injected in these reservoirs, the fluids used will preferentially travel through the path of the least resistance of high permeability layers leaving other zones uncontacted by the fluids. Poor horizontal and vertical sweep efficiencies in stratified reservoirs may lead to low rates of oil recovery. Accordingly, a need exists for maximizing oil recovery is such stratified reservoirs.

The present disclosure is directed to blocking the regions or layers of high permeability fractures in stratified reservoirs to improve the injectivity and oil recovery. In particular, in one aspect, embodiments disclosed herein relate generally to methods for enhancing the productivity of a subterranean wellbore through the use of responsive nanoparticles followed by in-situ acoustic wave generation to swell the nanoparticles in situ and block high permeability regions in different layers for enhanced sweep efficiency and better mobility control in stratified fractured reservoirs.

According to one or more embodiments, responsive nanoparticles are injected in the reservoir and acoustic waves are used to swell these nanoparticles and block high permeability regions in different layers.

More particularly, the method according to one or more embodiments may be used in a stratified reservoir having a first layer being located in a region of high permeability, a second layer being located in a region of medium permeability, and a third layer being located in a region of low permeability.

The responsive nanoparticles may be used in compositions including the responsive nanoparticles and water. The responsive nanoparticles may include particles having an average or a mean particle size of about 1 nanometers ("nm") to about 100 nm (e.g., about 5 nm to about 100 nm, about 10 nm to about 100 nm, about 20 nm to about 100 nm, about 30 nm to about 100 nm, about 40 nm to about 100 nm, about 50 nm to about 100 nm, about 60 nm to about 100 nm, about 70 nm to about 100 nm, about 80 nm to about 100 nm, about 90 nm to about 100 nm, 5 nm to about 95 nm, about 10 nm to about 95 nm, about 20 nm to about 95 nm, about 30 nm to about 95 nm, about 40 nm to about 95 nm, about 50 nm to about 95 nm, about 60 nm to about 95 nm, about 70 nm to about 95 nm, about 80 nm to about 95 nm, about 90 nm to about 95 nm, etc.).

In accordance with one or more embodiments, the nanoparticles may be included in water-based compositions in different forms, including, for example, as discrete nanoparticles, encapsulated nano particles, agglomerated nanoparticles, or in a liquid suspension. In certain embodiments, the nanoparticles may comprise at least about 1% by weight of the water-based composition. In certain embodiments, the nanoparticles may comprise about 1% to about 90%, or about 5% to about 85%, or about 10% to about 80%, or about 15% to about 75%, or about 20% to about 70%, or about 25% to about 65%, or about 30% to about 60%, or about 35% to about 55%, or about 40% to about 50%, by weight of the water-based composition. The nanoparticles may be in the form of solid particles that are present in a dry form at some point either prior to or during introduction into the water composition. The nanoparticles may be suspended in a liquid medium prior to introduction in the water composition.

The responsive nanoparticles may occupy narrow openings in various layers of stratified reservoirs having various levels of permeability and swell in these openings. Accordingly, the responsive nanoparticles may be suitable for use, for example, in oil recovery operations. For example, the responsive nanoparticles may be able to penetrate and seal spaces, including fractures, holes, cracks, spaces, or channels, in stratified reservoirs.

FIG. 1 is a flow diagram that illustrates steps included in the method of enhancing the productivity of a subterranean wellbore production in a stratified fractured reservoir in accordance with one or more embodiments. The method may include introducing a mixture comprising water and a first set of nanoparticles to a first target zone of the subterranean wellbore in a stratified fractured reservoir, where the first set of nanoparticles has a size in a range of about 10 to about 100 nm, and where the first target zone is located in a high permeability layer of the subterranean wellbore; providing a first stimulation to the first set of nanoparticles to promote the reacting, where the first stimulation comprises acoustic waves having a frequency range of 1 kHz to about 10 kHz; introducing water to the first target zone; introducing a mixture comprising water and a second set of nanoparticles to a second target zone of the subterranean wellbore, where the second set of nanoparticles has a size in a range of about 1 to about 10 nm, and where the second target zone is located in a medium permeability layer of the subterranean wellbore; providing a second stimulation to the second set of nanoparticles to promote the reacting where the second stimulation comprises acoustic waves having a frequency range of 100 Hz to about 1 kHz; introducing water to the second target zone. The details of each step included in the method are described further below.

More particularly, the steps of the method may include injecting a first small slug of responsive nanoparticles with sizes ranging from 10-100 nm, a pore volume of 0.1 $cm^3/g$, and reactive to high frequency acoustic waves (1-10 kHz); allowing the first slug to reach the target region of high permeability; lowering an acoustic tool to the target region and generating acoustic waves (1-10 kHz) for a period of 1 month; swelling the injected nanoparticles of the first small slug and allowing them to occupy larger pore throats and fractures in the high permeability region; injecting water for a period of 3 months and pushing the injected—expanded slug of the swelled nanoparticles; injecting a second small slug of responsive nanoparticles with sizes ranging from 1-10 nm, a pore volume of 0.1 $cm^3/g$, and reactive to low frequency acoustic waves (100 Hz-1 kHz); allowing the second slug to reach the targeted zone of medium permeability; lowering acoustic tool to the target depth of the medium permeability and generating acoustic waves (100 Hz-1 kHz) for a period of 1 month; swelling the nanoparticles of the second slug and allowing them to occupy larger pore throats and fractures of the zone of medium permeability; injecting water for 3 months for pushing the injected-expanded second slug of swelled nanoparticles; and injecting water in all three layers up to 1 pore volume, minimizing cross flow between the layers, providing uniform sweep efficiency and mobilizing remaining oil.

The stratified fractured reservoir may include a porous or fractured rock formation beneath the earth surface, which may be dry land or ocean bottom. The well system may be for a hydrocarbon well, such as an oil well, a gas well, a gas condensate well, or a mixture of hydrocarbon-bearing fluids. The reservoir may include different layers of rock having varying characteristics, such as degrees of density, permeability, porosity, and fluid saturations. The formation may include a low-pressure formation (for example, a gas-depleted former hydrocarbon-bearing formation) and a water-bearing formation (for example, fresh water, brine, former waterflood). In the case of the well system being operated as a production well, the well system may facilitate the extraction of hydrocarbons (or production) from a hydrocarbon-bearing reservoir. In the case of the well system being operated as an injection well, the well system may facilitate the injection of substances, such as gas or water, into a hydrocarbon-bearing reservoir.

The well system may include a subterranean wellbore including a bored hole that extends from the earth surface into the reservoir. The wellbore may be vertical, deviated, or horizontal. The wellbore may provide for the circulation of injection fluids to displace hydrocarbons within the reservoir. The injection fluid may be pumped into the reservoir forming a propagating flood fluid. Leakage of this flood fluid may occur when the fluid flows from permeable zones or fractures of the reservoir. In the present disclosure, permeable zones or fractures may refer to naturally occurring openings or fissures in the formation, fissures created by the drilling activities, or any other features of the formation in the vicinity of the wellbore which allow the migration of the flood fluid into the formation. The general location where the flood fluid is being lost into the formation may be referred to as a target zone. Leakage may occur at any location in the wellbore between the surface and the bottom of the wellbore and thus, any parts of the wellbore where leakage is occurring may be considered as a target zone.

Nanoparticles Reactive to High Frequency Acoustic Waves

Figure 2:
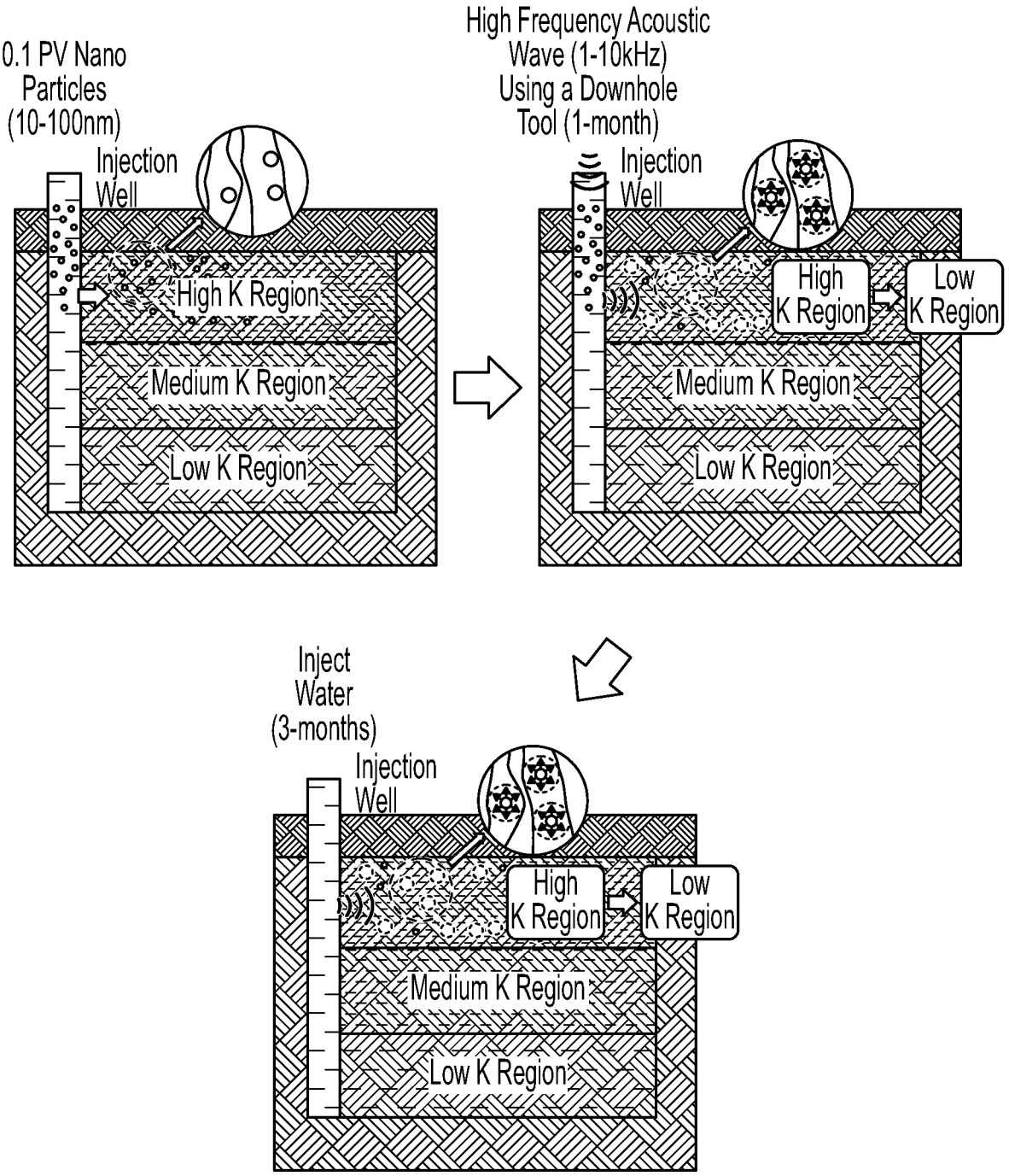
FIG. 2 is a diagram that illustrates the first steps in the method of enhancing the productivity of a subterranean wellbore production in a stratified fractured reservoir in accordance with one or more embodiments.

In one or more embodiments, a method of enhancing the productivity of a subterranean wellbore production in a stratified fractured reservoir may include introducing nanoparticles to a target zone of a subterranean wellbore. FIG. 2 illustrates a well environment in a stratified fractured reservoir in which nanoparticles reactive to high frequency acoustic waves are introduced into an upper layer of the wellbore, where the upper layer is located in a high permeability zone.

In one or more embodiments, nanoparticles reactive to high frequency acoustic waves may include any particles including metal particles, ceramic particles, crosslinkable polymers, polymerizable monomers, curable monomers and/or macromers, or gel forming compositions, or combinations thereof. More particularly, the nanoparticles responsive to high frequency acoustic waves may include, a cross-linking multi-functional monomer, a polymerization initiator, a cross-linking agent, a curing agent, a gel time moderating agent, a cure activator, or combinations thereof. Nanoparticles responsive to high frequency acoustic may also include metal particles such as iron, copper, and silver, among others. In particular embodiments, the metal particles may be encapsulated in a polymer or a surfactant and crosslinking agent. The nanoparticles reactive to high frequency acoustic waves may be excited by a stimulation, such as acoustic waves.

In one or more embodiments, the nanoparticles responsive to high frequency acoustic waves may include other components, such as water, saline, salt, aqueous base, oil, organic solvent, synthetic fluid oil phase, aqueous solution, alcohol or polyol, cellulose, starch, alkalinity control agent, density control agent, density modifier, surfactant, emulsifier, dispersant, polymeric stabilizer, crosslinking agent, polyacrylamide, polymer or combination of polymers, antioxidant, heat stabilizer, foam control agent, solvent, diluent, plasticizer, filler or inorganic particle, pigment, dye, precipitating agent, rheology modifier, oil-wetting agent, set retarding additive, surfactant, gas, accelerator, weight reducing additive, heavy-weight additive, lost circulation material, filtration control additive, dispersant, salts, fiber, thixotropic additive, breaker, crosslinker, gas, rheology modifier, density control agent, curing accelerator, curing retarder, pH modifier, chelating agent, scale inhibitor, enzyme, resin, water control material, polymer, oxidizer, a marker, or a combination thereof. In some embodiments, the nanoparticles may be in an amount by weight of the composition injected in the wellbore ranging from a lower limit selected from any of 5 wt %, 10 wt % and 15 wt %, to an upper limit selected from any of 60 wt %, 70 wt %, 80 wt %, 90 wt % and 100 wt %, where any lower limit may be used in combination with any upper limit.

In one or more embodiments, the shape of the nanoparticles responsive to high frequency acoustic waves may be spherical, cubic, cylindrical or any other regular or irregular shapes. In some embodiments, the nanoparticles may have a size ranging from about 10 nm to about 100 mm, such as a lower limit selected from any of about 10 nm, about 15 nm, about 20 nm, about 25 nm, about 30 nm, about 35 nm, about 40 nm, about 45 nm, about 50 nm, about 55 nm, about 60 nm, about 65 nm, about 70 nm, about 75 nm, about 80 nm, about 85 nm, about 90 nm about 95 nm, and about 100 nm to an upper limit selected from any of about 10 nm, about 15 nm, about 20 nm, about 25 nm, about 30 nm, about 35 nm, about 40 nm, about 45 nm, about 50 nm, about 55 nm, about 60 nm, about 65 nm, about 70 nm, about 75 nm, about 80 nm, about 85 nm, about 90 nm about 95 nm, and about 100 nm, where any lower limit may be used in combination with any upper limit.

In one or more embodiments, the nanoparticles are responsive to acoustic waves having a frequency range of about 1 kHz to about 10 kHz, such as a lower limit selected from any of about 1 kHz, 2 kHz, 3 kHz, 4 kHz, 5 kHz, 6 kHz, 7 kHz, 8 kHz, 9 kHz, or 10 kHz to an upper limit selected from any of about 1 kHz, 2 kHz, 3 kHz, 4 kHz, 5 kHz, 6 kHz, 7 kHz, 8 kHz, 9 kHz, or 10 kHz.

Nanoparticles Reactive to Low Frequency Acoustic Waves

Figure 3:
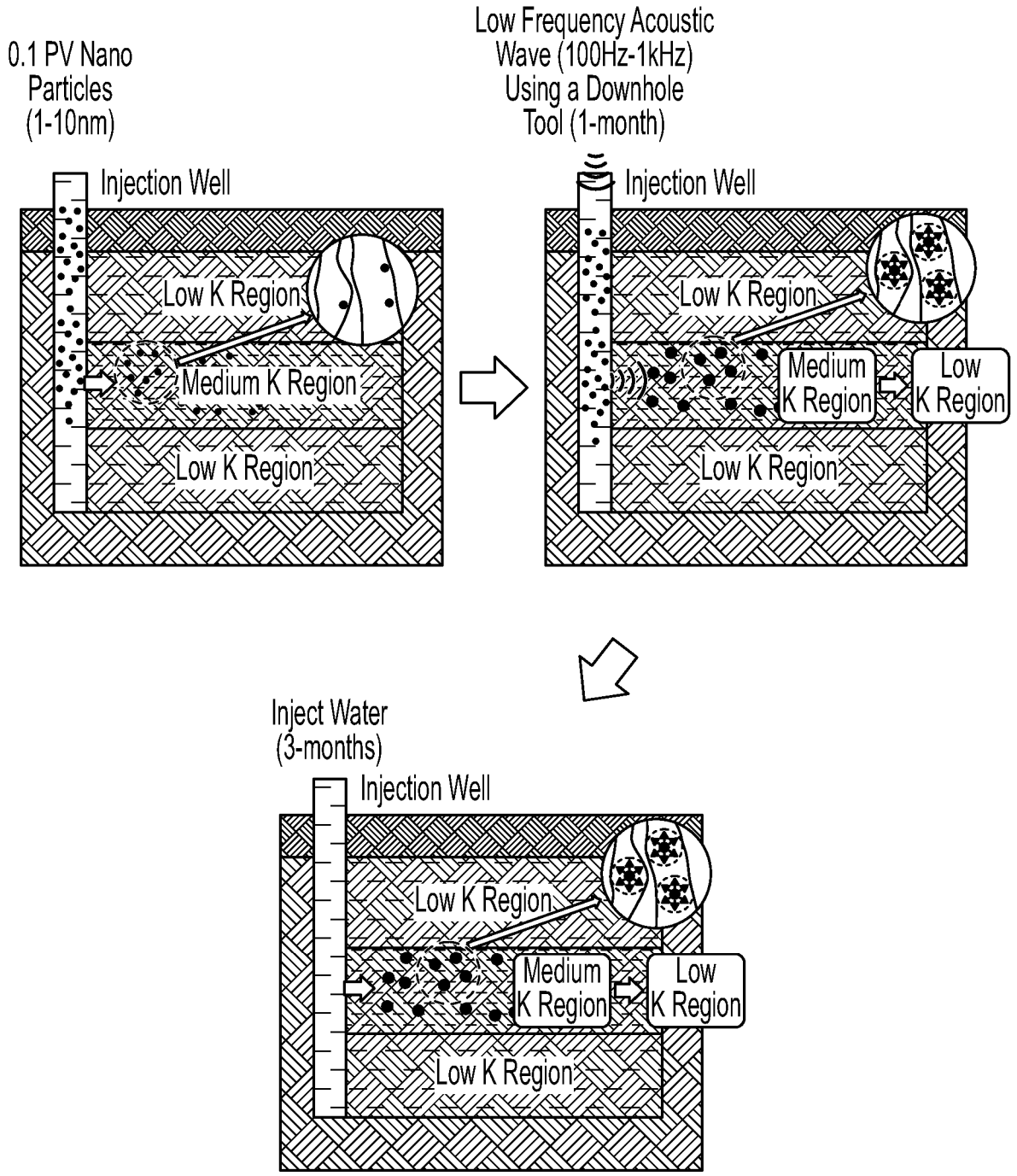
FIG. 3 is a diagram that illustrates the last steps in the method of enhancing the productivity of a subterranean wellbore production in a stratified fractured reservoir in accordance with one or more embodiments.

In one or more embodiments, a method of enhancing the productivity of a subterranean wellbore production in a stratified fractured reservoir may include introducing nanoparticles to a target zone of a subterranean wellbore. FIG. 3 illustrates a well environment in a stratified fractured reservoir in which nanoparticles reactive to low frequency acoustic waves are introduced into a middle layer of the wellbore, where the middle layer is located in a medium permeability zone.

In one or more embodiments, nanoparticles reactive to low frequency acoustic waves may include any particles including metal particles, ceramic particles, crosslinkable polymers, polymerizable monomers, curable monomers and/or macromers, or gel forming compositions, or combinations thereof. More particularly, the nanoparticles may include, a cross-linking multi-functional monomer, a polymerization initiator, a cross-linking agent, a curing agent, a gel time moderating agent, a cure activator, or combinations thereof. Nanoparticles responsive to high frequency acoustic may also include metal particles such as iron, copper, and silver, among others. In particular embodiments, the metal particles may be encapsulated in a polymer or a surfactant and crosslinking agent. The nanoparticles reactive to low frequency acoustic waves may be excited by a stimulation, such as acoustic waves.

In one or more embodiments, the nanoparticles may include other components, such as water, saline, salt, aqueous base, oil, organic solvent, synthetic fluid oil phase, aqueous solution, alcohol or polyol, cellulose, starch, alkalinity control agent, density control agent, density modifier, surfactant, emulsifier, dispersant, polymeric stabilizer, crosslinking agent, polyacrylamide, polymer or combination of polymers, antioxidant, heat stabilizer, foam control agent, solvent, diluent, plasticizer, filler or inorganic particle, pigment, dye, precipitating agent, rheology modifier, oil-wetting agent, set retarding additive, surfactant, gas, accelerator, weight reducing additive, heavy-weight additive, lost circulation material, filtration control additive, dispersant, salts, fiber, thixotropic additive, breaker, crosslinker, gas, rheology modifier, density control agent, curing accelerator, curing retarder, pH modifier, chelating agent, scale inhibitor, enzyme, resin, water control material, polymer, oxidizer, a marker, or a combination thereof. In some embodiments, the nanoparticles may be in an amount by weight of the composition injected in the wellbore ranging from a lower limit selected from any of 5 wt %, 10 wt % and 15 wt %, to an upper limit selected from any of 60 wt %, 70 wt %, 80 wt %, 90 wt % and 100 wt %, where any lower limit may be used in combination with any upper limit.

In one or more embodiments, the shape of the nanoparticles may be spherical, cubic, cylindrical or any other regular or irregular shapes. In some embodiments, the nanoparticles may have a size ranging from about 1 nm to about 10 mm, such as a lower limit selected from any of about 1 nm, about 1.5 nm, about 2 nm, about 2.5 nm, about 3 nm, about 3.5 nm, about 4 nm, about 4.5 nm, about 5 nm, about 5.5 nm, about 6 nm, about 6.5 nm, about 7 nm, about 7.5 nm, about 8 nm, about 8.5 nm, about 9 nm about 9.5 nm, and about 10 nm to an upper limit selected from any of about 1 nm, about 1.5 nm, about 2 nm, about 2.5 nm, about 3 nm, about 3.5 nm, about 4 nm, about 4.5 nm, about 5 nm, about 5.5 nm, about 6 nm, about 6.5 nm, about 7 nm, about 7.5 nm, about 8 nm, about 8.5 nm, about 9 nm about 9.5 nm, and about 10 nm, where any lower limit may be used in combination with any upper limit.

In one or more embodiments, the nanoparticles are responsive to acoustic waves having a frequency range of about 100 Hz to about 1 kHz, such as a lower limit selected from any of about 100 Hz, 200 Hz, 300 Hz, 400 Hz, 500 Hz, 600 Hz, 700 Hz, 800 Hz, 900 Hz, or 1 kHz to an upper limit selected from any of about 100 Hz, 200 Hz, 300 Hz, 400 Hz, 500 Hz, 600 Hz, 700 Hz, 800 Hz, 900 Hz, or 1 kHz.

Introduction of Nanoparticles Reactive to High Frequency Acoustic Waves

In some embodiments, the nanoparticles responsive to high frequency acoustic waves may be introduced to the wellbore, including a high permeability target zone, by incorporating the nanoparticles responsive to high frequency acoustic waves into a base fluid. A base fluid containing the nanoparticles responsive to high frequency acoustic waves may be any type of fluid that is suitable for dispersing the nanoparticles responsive to high frequency acoustic waves and carrying the nanoparticles to be introduced to the target zone of the wellbore. In some embodiments, the base fluid may contain additional fluids or additives. In some embodiments, the base fluid may be water.

In one or more embodiments, the base fluid may contain nanoparticles responsive to high frequency acoustic waves in an amount ranging from about 0.1 wt % to 90 wt %. In some embodiments, the base fluid may contain nanoparticles responsive to high frequency acoustic waves in an amount ranging from a lower limit selected from any of 0.1 wt %, 0.5 wt %, 1 wt %, 2 wt %, 3 wt %, 4 wt %, and 5 wt % to an upper limit selected from any of 40 wt %, 50 wt %, 60 wt %, 70 wt %, 80 wt % and 90 wt %, where any lower limit may be used in combination with any upper limit.

In other embodiments, the nanoparticles responsive to high frequency acoustic waves may be introduced to a stratified wellbore, including a target zone located in a high permeability zone of the wellbore, by incorporating the nanoparticles into a base fluid. The nanoparticles may thus be introduced to specific areas of the wellbore, such as the target zone, where the nanoparticles may come into contact with water, as described in detail below.

In one or more embodiments, the amount of nanoparticles introduced to the wellbore may be adjusted according to the permeability of the target zone and other operational factors such as, but not limited to, the flow rate and viscosity of the injection fluid.

Stimulation of Nanoparticles Reactive to High Frequency Acoustic Waves

In one or more embodiments, the method of enhancing productivity of a subterranean wellbore may include providing stimulation to the nanoparticles. Stimulation may include, but is not limited to, a form of energy such as sound energy. In some embodiments, the stimulation may promote reaction, swelling or expansion of the nanoparticles. FIG. 2 illustrates a well environment in which the nanoparticles are introduced to the high permeability target zone of the wellbore, and a stimulation is being provided.

In some embodiments, the stimulation may be provided as an energy form including acoustic waves. In one or more embodiments, the stimulation may be provided by a stimulation generator, such as an acoustic wave generator. Such generator may be incorporated into any suitable portion of the wellbore and may located within such portion via wireline placement for example. The stimulation may be provided continuously, or intermittently. The acoustic waves having a frequency range of about 1 kHz to about 10 kHz may be generated using a downhole acoustic wave generation tool. The tool may be placed permanently downhole or can be retrievable and used during the treatment operation. The acoustic waves may be applied to the high permeability target zone for a duration of about 1 week to 3 months, or about 2 weeks to 2 months, or for about 1 month and they may be adjusted and optimized based on the specific conditions of the enhanced productivity. The acoustic waves allow the nanoparticles introduced into the high permeability zone of the stratified wellbore to react and expand in size to about 10 to 100 microns. For example, in one or more embodiments, the nanoparticles may swell to a size having a lower limit of any of 10, 15, 20, 25, 30, 35, and 40 microns to an upper limit of any of 60, 70, 80, 85, 90, 95, and 100 microns, where any lower limit may be used in combination with any upper limit.

The nanoparticle may swell and occupy larger pore throats and fractures in the high permeability region and result in the reduction the overall permeability of the target zone.

Introduction of Nanoparticles Reactive to Low Frequency Acoustic Waves

In some embodiments, the nanoparticles responsive to low frequency acoustic waves may be introduced to the wellbore, including a medium permeability target zone, by incorporating the nanoparticles responsive to low frequency acoustic waves into a base fluid. A base fluid containing the nanoparticles responsive to low frequency acoustic waves may be any type of fluid that is suitable for dispersing the nanoparticles responsive to low frequency acoustic waves and carrying the nanoparticles to be introduced to the target zone of the wellbore. In some embodiments, the base fluid may contain additional fluids or additives. In some embodiments, the base fluid may be water.

In one or more embodiments, the base fluid may contain nanoparticles responsive to low frequency acoustic waves in an amount ranging from about 0.1 wt % to 90 wt %. In some embodiments, the base fluid may contain nanoparticles responsive to low frequency acoustic waves in an amount ranging from a lower limit selected from any of 0.1 wt %, 0.5 wt %, 1 wt %, 2 wt %, 3 wt %, 4 wt %, and 5 wt % to an upper limit selected from any of 40 wt %, 50 wt %, 60 wt %, 70 wt %, 80 wt % and 90 wt %, where any lower limit may be used in combination with any upper limit.

In other embodiments, the nanoparticles responsive to low frequency acoustic waves may be introduced to a stratified wellbore, including a target zone located in a medium permeability zone of the wellbore, by incorporating the nanoparticles into a base fluid. The nanoparticles may thus be introduced to specific areas of the wellbore, such as the target zone, where the nanoparticles may come into contact with water, as described in detail below.

In one or more embodiments, the amount of nanoparticles introduced to the wellbore may be adjusted according to the permeability of the target zone and other operational factors such as, but not limited to, the flow rate and viscosity of the injection fluid.

Stimulation of Nanoparticles Reactive to Low Frequency Acoustic Waves

In one or more embodiments, the method of enhancing productivity of a subterranean wellbore may include providing stimulation to the nanoparticles. Stimulation may include, but is not limited to, a form of energy such as sound energy. In some embodiments, the stimulation may promote reaction, swelling or expansion of the nanoparticles. FIG. 3 illustrates a well environment in which the nanoparticles are introduced to the medium permeability target zone of the wellbore, and a stimulation is being provided.

In some embodiments, the stimulation may be provided as an energy form including acoustic waves. In one or more embodiments, the stimulation may be provided by a stimulation generator, such as an acoustic wave generator. Such generator may be incorporated into any suitable portion of the wellbore and may located within such portion via wireline placement for example. The stimulation may be provided continuously, or intermittently. The acoustic waves having a frequency range of about 100 Hz to about 1 kHz may be generated using a downhole acoustic wave generation tool. The tool may be placed permanently downhole or can be retrievable and used during the treatment operation. The acoustic waves may be applied to the medium permeability target zone for a duration of about 1 week to 3 months, or about 2 weeks to 2 months, or for about 1 month and they may be adjusted and optimized based on the specific conditions of the enhanced productivity. The acoustic waves allow the nanoparticles introduced into the medium permeability zone of the stratified wellbore to react and expand in size to about 10 to 100 microns. For example, in one or more embodiments, the nanoparticles may swell to a size having a lower limit of any of 10, 15, 20, 25, 30, 35, and 40 microns to an upper limit of any of 60, 70, 80, 85, 90, 95, and 100 microns, where any lower limit may be used in combination with any upper limit.

The nanoparticle may swell and occupy larger pore throats and fractures in the medium permeability region and result in the reduction the overall permeability of the target zone.

Introduction of Water

In one or more embodiments, the method of enhancing productivity of a subterranean wellbore may include introducing water to the high permeability target zone of the stratified wellbore after the introduction and stimulation of the nanoparticles responsive to high frequency acoustic waves to push the injected expanded nanoparticles out from the high permeability zone.

In one or more embodiments, the method of enhancing productivity of a subterranean wellbore may include introducing water to the medium permeability target zone of the stratified wellbore after the introduction and stimulation of the nanoparticles responsive to low frequency acoustic waves to push the injected expanded nanoparticles out from the medium permeability zone.

In some embodiments, the water may be fresh water or saltwater, and may be obtained from natural sources or artificially produced. In some embodiments, the water may be introduced into the wellbore continuously or intermittently for a period of about 2 to about 5 months, or about 3 to about 5 months. In one or more embodiments, the water may have a pH of about 5.5 to about 7.5.

In some embodiments, the method of enhancing the productivity of a subterranean wellbore may include, repeating one or more of the steps described above. In some embodiments, the repeating steps may include all steps included in the method of enhancing the productivity of the stratified subterranean wellbore. In other embodiments, selective steps of the method may be repeated. The number of repeated steps is not limited and may be repeated as many times as necessary until the productivity, injectivity, and sweep efficiency are enhanced. Each repeated process step may be the same as the previous iteration, or may be different, and may be adjust in accordance with a specific target for the productivity enhancement.

In some embodiments, the stimulation generator may include an acoustic wave generator and may further include a control device such as a mobile control device, a sensor, a retrieval/deployment line, or a motor, capable of transferring to any location along the wellbore. The movement of the control device may be controlled mechanically by a retrieval/deployment line connected to the mitigation device and a line retrieval/deployment means such as a reel or a winch.

In some embodiments, the control device may contain sensors which may include a camera, scanner, logging and scanning ring, hole caliper, or any other devices which may be used to measure or record various aspects of the downhole environment and the plugging process of the formation target zone. In some embodiments, the monitoring of the target zone may be conducted by the sensors included in the control device.

The method according to one or more embodiments may be used in a stratified reservoir having an upper layer being a region of high permeability, a middle layer being a region of medium permeability and a lower region being a region of low permeability. The steps of the method may include injecting a first small slug (0.1 pore volume) of responsive nanoparticles (10-100 nm) reactive to high frequency acoustic wave (1-10 kHz); allowing the first slug to reach the target region of high permeability; lowering an acoustic tool to the target region and generating acoustic waves (1-10 kHz) for a period of 1 month; swelling the injected nanoparticles of the first small slug and allowing them to occupy larger pore throats and fractures in the high permeability region; injecting water for a period of 3 months and pushing the injected—expanded slug of the swelled nanoparticles; injecting a second small slug (0.1 pore volume) of responsive nanoparticles (1-10 nm), slug B, reactive to low frequency acoustic waves (100 Hz-1 kHz); allowing the second slug to reach the targeted zone of medium permeability; lowering acoustic tool to the target depth of the medium permeability and generating acoustic waves (100 Hz-1 kHz) for a period of 1 month; swelling the nanoparticles of the second slug and allowing them to occupy larger pore throats and fractures of the zone of medium permeability; injecting water for 3 months for pushing the injected-expanded second slug of swelled nanoparticles; and injecting water in all three layers up to 1 pore volume, minimizing cross flow between the layers, providing uniform sweep efficiency and mobilizing remaining oil.

Figure 4:
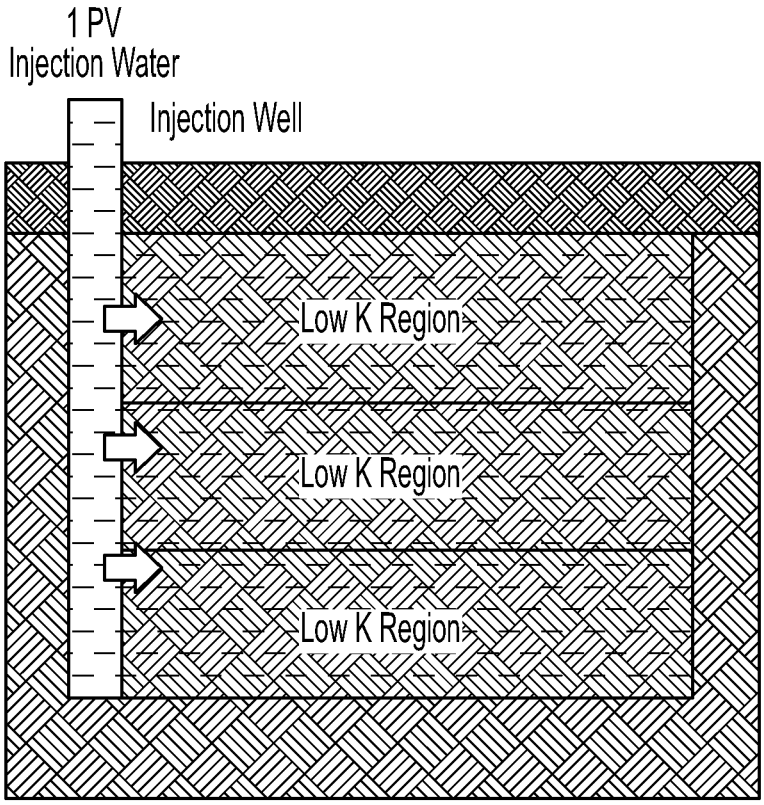
FIG. 4 is a diagram that illustrates the resulting enhancement of the productivity of a subterranean wellbore production in a stratified fractured reservoir from the method in accordance with one or more embodiments.

FIG. 4 illustrates a well environment in which the nanoparticles responsive to high frequency acoustic waves have sealed fractures in the high permeability zone of the stratified wellbore after their introduction and stimulation, and in which the nanoparticles responsive to low frequency acoustic waves have sealed fractures in the medium permeability zone of the stratified wellbore after their introduction and stimulation, thus reducing the permeability contrast between the zones of the stratified wellbore and thus enhancing the productivity. Injection of water in all three layers of the stratified wellbore by up to 1 pore volume may result in minimizing crossflow between layers, providing uniform sweep efficiency and effectively mobilizing the remaining oil for higher oil recovery.

The method of enhancing the productivity of a subterranean wellbore described in the previous paragraphs may be applied to injection well, a production well, a deep well, a shallow single well, a shallow multilateral well, a vertical well, or a horizontal well.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A method for enhancing productivity of a stratified subterranean wellbore, the method comprising:

introducing a mixture comprising water and a first set of nanoparticles to a first target zone of the stratified subterranean wellbore, where the first set of nanoparticles is reactive to high frequency acoustic waves and has a size in a range of about 10 to about 100 nm, and where the first target zone is located in a high permeability layer of the stratified subterranean wellbore;

providing a first stimulation to the first set of nanoparticles to promote a reacting of the first set of nanoparticles, where the first stimulation comprises acoustic waves having a frequency range of 1 kHz to about 10 kHz;

introducing water to the first target zone;

introducing a mixture comprising water and a second set of nanoparticles to a second target zone of the stratified subterranean wellbore, where the second set of nanoparticles has a size in a range of about 1 to about 10 nm, and where the second target zone is located in a medium permeability layer of the stratified subterranean wellbore;

providing a second stimulation to the second set of nanoparticles to promote a reacting of the second set of nanoparticles, where the second stimulation comprises acoustic waves having a frequency range of 100 Hz to about 1 kHz; and introducing water to the second target zone.

2. The method of claim 1, wherein the mixture comprising water and the first set of nanoparticles is injected at a pore volume of 0.1 $cm^3/g$.

3. The method of claim 1, wherein the mixture comprising water and the second set of nanoparticles is injected at a pore volume of 0.1 $cm^3/g$.

4. The method of claim 1, further comprising introducing water in all target zones of the subterranean wellbore, wherein a crossflow between the target zones is minimized.

5. The method of claim 4, wherein the water is introduced in all target zones at a pore volume of 1 $cm^3/g$.

6. The method of claim 1, wherein the providing the first stimulation has a duration of about 1 month.

7. The method of claim 1, wherein the introducing water to the first target zone has a duration of about 3 months.

8. The method of claim 1, wherein the providing the second stimulation has a duration of about 1 month.

9. The method of claim 1, wherein the introducing water to the second target zone has a duration of about 3 months.

10. The method of claim 1, wherein the productivity of an injection well or a production well is enhanced.

11. The method of claim 1, wherein the stratified subterranean wellbore is a deep wellbore.

12. The method of claim 1, wherein the first stimulation and the second stimulation are provided by an acoustic wave generator.

* * * * *